US008302629B2

(12) United States Patent
Hattori

(10) Patent No.: US 8,302,629 B2
(45) Date of Patent: Nov. 6, 2012

(54) VALVE UNIT

(75) Inventor: Masakazu Hattori, Gifu (JP)

(73) Assignee: Nabtesco Corporation, Tokyo (JP)

( * ) Notice: Subject to any disclaimer, the term of this patent is extended or adjusted under 35 U.S.C. 154(b) by 365 days.

(21) Appl. No.: 12/725,161

(22) Filed: Mar. 16, 2010

(65) Prior Publication Data

US 2010/0236652 A1 Sep. 23, 2010

(30) Foreign Application Priority Data

Mar. 18, 2009 (JP) ..... 2009-065544

(51) Int. Cl.
*F15B 13/043* (2006.01)

(52) U.S. Cl. ..... 137/625.62; 137/625.61

(58) Field of Classification Search ..... 137/625.61, 137/625.62, 625.63
See application file for complete search history.

(56) References Cited

U.S. PATENT DOCUMENTS 2,886,009 A * 5/1959 Myers ..... 137/625.62
2,944,524 A * 7/1960 Brandstadter et al. ... 137/625.62
3,552,433 A * 1/1971 Mason ..... 137/625.62
4,050,476 A * 9/1977 Hayner et al. ..... 137/625.62
4,456,031 A * 6/1984 Taplin ..... 137/625.62
4,624,284 A * 11/1986 Lembke ..... 137/625.62
2007/0215222 A1 * 9/2007 Rauch et al. ..... 137/625.62

FOREIGN PATENT DOCUMENTS

JP 4-64702 2/1992
JP 2007-303642 11/2007

OTHER PUBLICATIONS esp@cenet patent abstract for Japanese Publication No. 2007303642, Publication date Nov. 22, 2007 (1 page).
esp@cenet patent abstract for Japanese Publication No. 4064702, Publication date Feb. 28, 1992 (1 page).

* cited by examiner

*Primary Examiner* — John Rivell
(74) *Attorney, Agent, or Firm* — Osha Liang LLP

(57) ABSTRACT

A valve unit 1 includes a first valve body 14 which is slidable in a valve housing 11 and a second valve body 13 which is slidable with respect to the first valve body 14, and the valve housing 11 has a first passage 11*a* and a second passage 11*b* in both of which pressure fluid flows to slide the second valve body 13, a pump port 11*c*, a tank port 11*e*, a first cylinder port 11*d*, and a second cylinder port 11*f*. A first state 1*a*, a third state 1*c*, a second state 1*b*, and a fourth state 1*d* are realized by a combination of a position of the first valve body 14 after sliding and a position of the second valve body 13 after sliding with respect to the first valve body 14.

5 Claims, 6 Drawing Sheets

VALVE UNIT

CROSS REFERENCE TO RELATED APPLICATION

The present application claims priority from Japanese Patent Application No. 2009-65544, which was filed on Mar. 18, 2009, the disclosure of which is herein incorporated by reference in its entirety.

BACKGROUND OF THE INVENTION

The present invention relates to a valve unit, and particularly relates to a valve unit which changes the direction of fluid flow, prohibits fluid flow, and allows fluid flow, by switching the position of a valve body in a valve housing.

Such a technology is recited in, for example, Japanese Unexamined Patent Publication No. 303642/2007 (Tokukai 2007-303642). A valve unit recited in this document is arranged so that a first valve body (24) and a second valve body (26) are disposed in a single valve housing, in a slidable manner. By selecting a combination of a position of the first valve body (24) and a position of the second valve body (26) with respect to the first valve body (24) after these bodies are slid, it is possible to change the direction of fluid flow, prohibit fluid flow, and allow fluid flow. This technology recited in the patent document 1 makes it possible to obtain a small-sized, lightweight valve unit.

The valve unit of Japanese Unexamined Patent Publication No. 303642/2007, however, is arranged so that the second valve body (26) is slid by an electric motor attached to the edge of the valve unit. This electric motor requires a relatively large space in the valve unit, and increases the weight of the valve unit. Furthermore, the overall power consumption is high because the second valve body (26) is electrically driven.

SUMMARY OF THE INVENTION

The present invention was done to solve the problems above, and an objective of the present invention is to provide a small-sized, lightweight valve unit of low power consumption.

To achieve the objective above, the present invention provides a valve unit comprising: a valve housing; a first valve body disposed in the valve housing in a slidable manner; and a second valve body disposed to be slidable with respect to the first valve body. The valve housing includes: a first passage and a second passage in which pressure fluid flows to slide the second valve body; a pump port connected to a pump; a tank port connected to a tank; and a first cylinder port and a second cylinder port both connected to a cylinder of a hydraulic actuator. A combination of a position of the first valve body after sliding and a position of the second valve body after sliding with respect to the first valve body achieves: a first state in which the pump port is connected to the first cylinder port whereas the second cylinder port is connected to the tank port; a second state in which the pump port is connected to the second cylinder port whereas the first cylinder port is connected to the tank port; a third state in which the pump port, the tank port, the first cylinder port, and the second cylinder port are closed; and a fourth state in which the pump port is closed whereas the first cylinder port is connected to the second cylinder port.

According to this arrangement, the second valve body is slid by the pressure fluid. The valve unit of the present invention does not therefore require an electric motor, and hence this valve unit is small in size, lightweight, and consumes a small amount of power, as compared to the conventional valve units.

The present invention is preferably arranged so that the position of the second valve body is controlled based on a position signal supplied from a feedback spring, a part of the feedback spring being provided in the valve housing.

This arrangement further ensures the downsizing of the valve unit.

In addition to the above, the present invention is preferably arranged so that the first valve body is disposed to be slidable with respect to an inner surface of the second valve body, and the first valve body is provided at its end portion with a first spring which biases the first valve body.

According to this arrangement, the first spring makes it possible to assuredly slide the first valve body, and in another aspect, the first valve body is fixedly provided around the center of the valve unit.

In addition to the above, the present invention is preferably arranged so that the first valve body is disposed to be slidable with respect to an outer surface of the second valve body, the first valve body is provided at its end portion with a first spring which biases the first valve body, and the second valve body is provided at its respective end portions with a second spring and a third spring both of which bias the second valve body.

According to this arrangement, the first spring makes it possible to assuredly slide the first valve body, and in another aspect, the first valve body is fixedly provided around the center of the valve unit. Furthermore, the second spring and the third spring allow the second valve body to smoothly move, and in another aspect, the second valve body is fixedly provided around the center of the valve unit.

The valve unit according to the present invention is suitable for controlling airplane control surfaces such as flaps, ailerons, elevators, and rudders.

DESCRIPTION OF THE PREFERRED EMBODIMENTS

The following will describe an embodiment of the present invention with reference to figures. An airplane is provided on its wings with plural moving parts (airplane control surfaces) for changing the flight attitude, the direction of flight, and receiving lift forces. Examples of such moving parts (airplane control surfaces) include flaps, ailerons, elevators, and rudders. The valve unit according to the present invention is suitable for controlling these moving parts (airplane control surfaces).

(First Embodiment)

Figure 1:
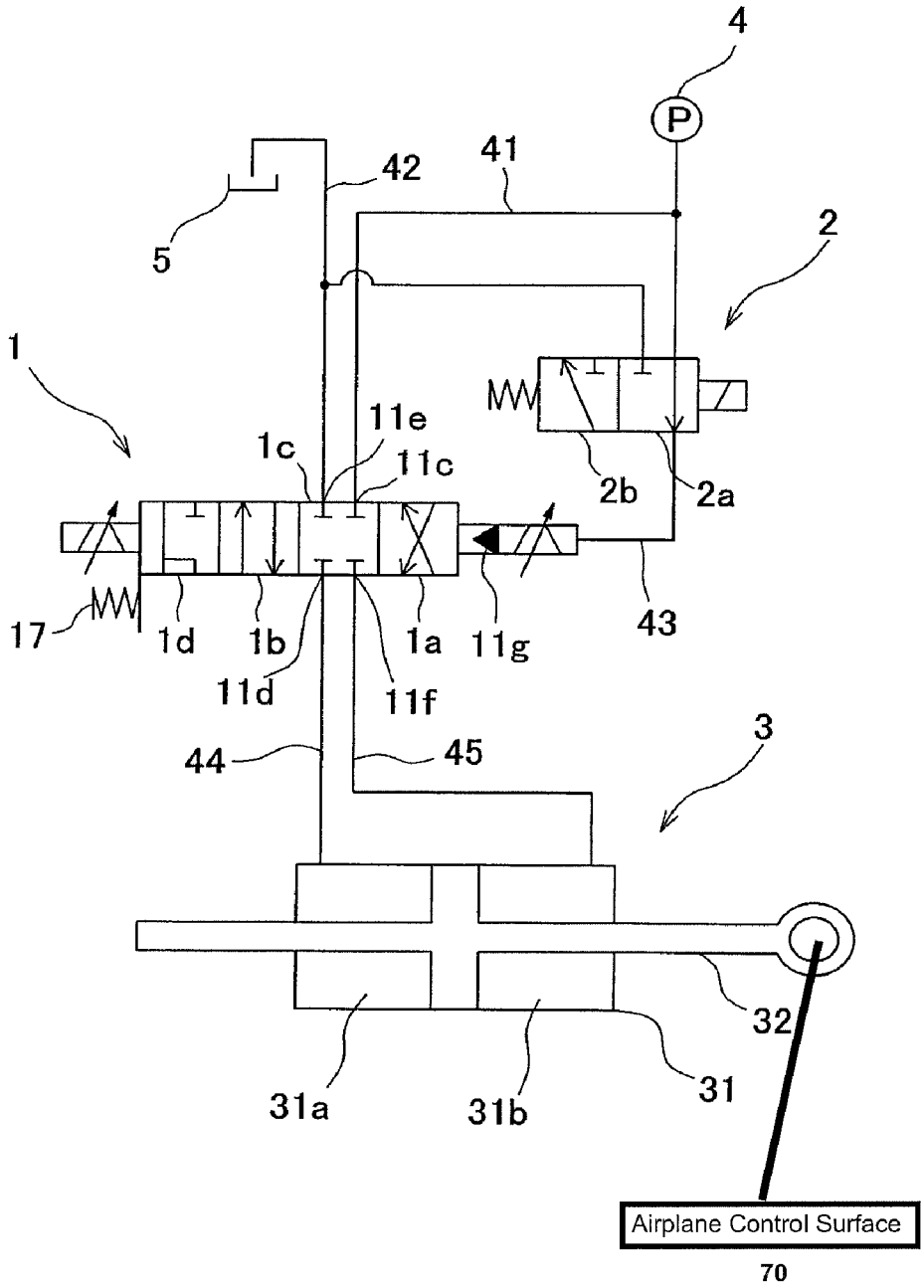
FIG. 1 is a circuit diagram showing a hydraulic circuit in which a valve unit of First Embodiment according to the present invention is incorporated.

FIG. 1 is a circuit diagram of a hydraulic circuit in which a valve unit 1 of First Embodiment according to the present invention is incorporated.

The hydraulic circuit shown in FIG. 1 includes a pump 4 (hydraulic pump), a hydraulic actuator 3, a valve unit 1, a pilot valve 2, and a tank 5. The pump 4 ad the valve unit 1 are connected to each other by a hydraulic supply passage 41. The tank 5 and the valve unit 1 are connected to each other by a drain passage 42. The valve unit 1 and the hydraulic actuator 3 are connected to each other by a first cylinder passage 44 and a second cylinder passage 45. The valve unit 1 and the pilot valve 2 are connected to each other by a pilot passage 43.

(Valve Unit)

As shown in FIG. 1, the valve unit 1 has a pump port 11*c* and a tank port 11*e*. The valve unit 1 is connected to the pump 4 at the pump port 11*c* via the hydraulic supply passage 41, and is also connected to the tank 5 at the tank port 11*e* via the drain passage 42. The valve unit 1 has a first cylinder port 11*d* and a second cylinder port 11*f*. The valve unit 1 is, at the first cylinder port 11*d* and the second cylinder port 11*f*, connected to the hydraulic actuator 3 via the first cylinder passage 44 and the second cylinder passage 45, respectively.

The valve unit 1 is a four position valve having a first state 1*a*, a second state 1*b*, a third state 1*c*, and a fourth state 1*d*. The first state 1*a* through the third state 1*c* are provided for a normal mode whereas the fourth state 1*d* is provided for a bypass mode.

In the first state 1*a*, the pump port 11*c* is connected to the first cylinder port 11*d* whereas the second cylinder port 11*f* is connected to the tank port 11*e*. In the second state 1*b*, the pump port 11*c* is connected to the second cylinder port 11*f* whereas the first cylinder port 11*d* is connected to the tank port 11*e*. In the third state 1*c*, the pump port 11*c*, the tank port 11*e*, the first cylinder port 11*d*, and the second cylinder port 11*f* are closed (mutually blocked).

In the fourth state 1*d*, the pump port 11*c* is closed whereas the first cylinder port 11*d* is connected to the second cylinder port 11*f*. In the present embodiment, the first cylinder port 11*d*, the second cylinder port 11*f*, and the tank port 11*e* are connected to one another in the fourth state 1*d*. The fourth state 1*d* may be alternatively arranged so that the first cylinder port 11*d* and the second cylinder port 11*f* are not connected to the tank port 11*e* (i.e. the tank port 11*e* is closed).

(Structure of Valve Unit)

Figure 2:
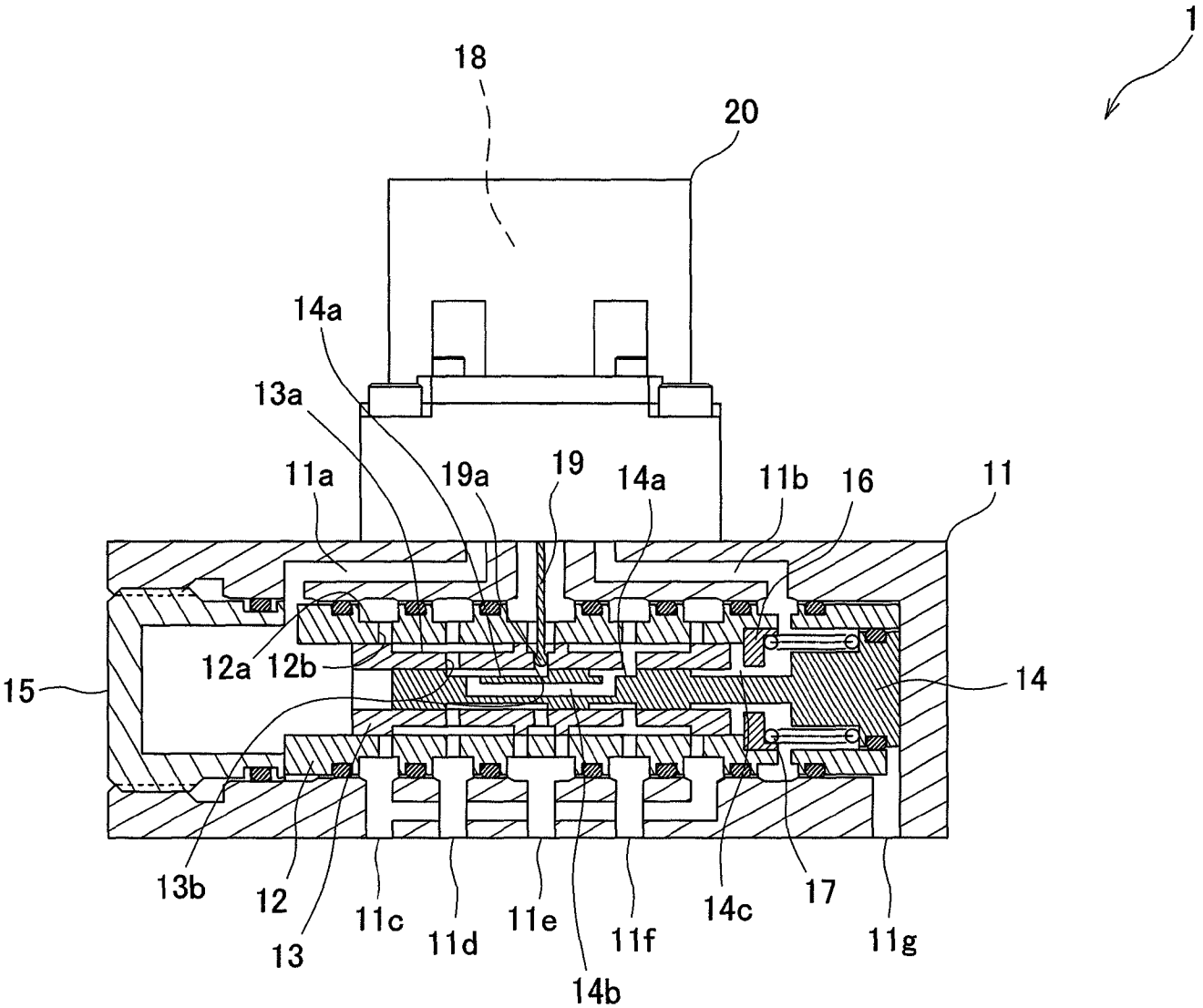
FIG. 2 shows the structure of the valve unit of FIG. 1.

FIG. 2 shows the structure of the valve unit 1 of FIG. 1. It is noted that the same reference numerals are assigned to components having substantially identical arrangements as those of FIG. 1. The valve unit 1 shown in FIG. 2 is in the fourth state 1*d* (bypass mode). As shown in FIG. 2, the valve unit 1 is provided with a valve housing 11 and a casing 20 attached to one surface of the valve housing 11.

(Valve Housing)

Inside the valve housing 11, a first passage 11*a* and a second passage 11*b* are formed on the casing 20 side to allow pressure fluid for sliding a later-described second valve body 13 to flow therein. On another surface of the valve housing 11 are formed the pump port 11*c* connected to the pump 4, the tank port 11*e* connected to the tank 5, the first cylinder port 11*d* and the second cylinder port 11*f* connected to a cylinder 31 of the hydraulic actuator 3, and a pilot port 11*g* connected to the pilot valve 2.

The valve housing 11 stores therein components such as an outer sleeve 12, a second valve body 13, and a first valve body 14.

The valve housing 11 is sealed by screwing a cap 15 into one end of the housing 11. The outer shape of the valve housing 11 is rectangular parallelepiped, for example.

(Second Valve Body)

To the inner surface of the valve housing 11, a tubular outer sleeve 12 is fixed. On the outer surface of the outer sleeve 12 are formed plural (6 in the present embodiment) ring-shaped circumferential grooves 12*a*. The space inside the outer sleeve 12 is connected to the grooves 12*a* via passages 12*b* formed in the outer sleeve 12.

The outer sleeve 12 houses therein a tubular second valve body 13 to be slidable with respect to the inner surface of the outer sleeve 12. On the outer surface of the second valve body 13, plural ring-shaped circumferential grooves 13*a* are formed. (In the present embodiment, two wide grooves and one narrow groove are formed.) The space inside the second valve body 13 is connected to the grooves 13*a* by passages 13*b* formed in the second valve body 13.

(First Valve Body)

The second valve body 13 houses therein a stick-shaped first valve body 14 to be slidable with respect to the inner surface of the second valve body 13. On one side of the first valve body 14, plural (two in the present embodiment) ring-shaped circumferential grooves 14*a* are formed on the outer surface. These two grooves 14*a* are connected to each other by a passage 14*b* formed in the first valve body 14.

On the other end of the first valve body 14, a first spring 17 (coil spring) is provided to bias the first valve body 14 in an axial direction. Between the first spring 17 and the second valve body 13, a ring-shaped collar 16 is inserted. This collar 16 has a notch (which is not illustrated; i.e. slit). By this notch, the second passage 11*b* is connected to the passage 14*c* inside the collar 16.

(Casing)

The casing 20 houses therein an electromagnetic mechanism 18. This electromagnetic mechanism 18 has a flapper (not illustrated), and a stick-shaped feedback spring 19 is attached to the leading end of the flapper. The feedback spring 19 has a spheric portion 19*a* at the leading end and this spheric portion 19 is housed in the passage 13*b* of the second valve body 13. The width of the passage 13*b* is substantially equal to the external diameter of the spheric portion 19*a*. The feedback spring 19 is provided for detecting the position of the second valve body 13. As the spheric portion 19*a* at the leading end of the feedback spring 19 moves with the second valve body 13, it is possible to precisely detect the position of the second valve body 13. The position of the second valve body 13 is controlled based on a position signal from the feedback spring 19. In consideration of downsizing and structural simplification of the valve unit 1, the feedback spring 19 is preferred as in the present embodiment: however, the position of the second valve body 13 may be detected by position detection means such as a differential transformer.

(Hydraulic Actuator)

Turning back to FIG. 1, the hydraulic actuator 3 has a cylinder 31 and a piston rod 32. The piston rod 32 is moved by pressure fluid which is ejected to a first cylinder chamber 31*a* and a second cylinder chamber 31*b* from the pump 4 via the valve unit 1. The piston rod 32 is connected to, at its leading end, an airplane control surface 70 which is a flap, an aileron or the like of the airplane.

(Pilot Valve)

The pilot valve 2 is a solenoid valve for switching the valve unit 1 to the states (first state 1*a* through third state 1*c*) of the normal mode and the state (fourth state 1*d*) of the bypass mode. As the pilot valve 2 is electromagnetically operated, the pilot valve 2 is switched to the connection state 2*a*, so that a pilot pressure is introduced into the valve unit 1 via the pilot port 11*g*. With this, the valve unit 1 is switched to the normal mode. On the other hand, when the valve unit 1 is to be switched to the bypass mode, the pilot valve 2 is switched to the cutoff state 2*b* by instructing the pilot valve 2 to stop the electromagnetic force. The valve unit 1 is also switched to the bypass mode because the pilot pressure is lost, when the pump 4 is broken down for some reason.

(Operation of Valve Unit)

Now, the operation of the valve unit 1 will be described with reference to FIGS. 1-3. FIG. 3A through FIG. 3D are cross sections for describing the operation of the valve unit 1. FIG. 3A, FIG. 3B, FIG. 3C, and FIG. 3D show the first state 1*a*, the third state 1*c*, the second state 1*b*, and the fourth state 1*d* of the valve unit 1, respectively. It is noted that the same reference numerals are assigned to components having substantially identical arrangements as those of FIG. 2.

(Bypass Mode)

When the pilot valve 2 does not produce an electromagnetic force or when the pump 4 is broken down, no pilot pressure is introduced into the valve unit 1 via the pilot port 11*g*. In this case, the first valve body 14 is on the right side of the figure on account of the biasing force of the first spring 17 (i.e. the first valve body 14 is at a standstill as the end face of the first valve body 14 is in contact with the inner wall of the valve housing 11). With this, as shown in FIG. 3D, the fourth state 1*d* is reached so that the pump port 11*c* is closed while the first cylinder port 11*d*, the second cylinder port 11*f*, and the tank port 11*e* are connected to one another. As the first cylinder port 11*d* is connected to the second cylinder port 11*f*, the piston rod 32 of the hydraulic actuator 3 becomes movable by an external force (not illustrated).

As discussed above, the valve unit 1 shown in FIG. 2 is in the fourth state 1*d* (bypass mode). Although FIG. 2 shows that as if the passage 13*b* is closed by the spheric portion 19*a* at the leading end of the feedback spring 19, in reality the passage 13*b* is not closed by the spheric portion 19*a*. For example, the width of the passage 13*b* in the direction orthogonal to the figure is longer than the external diameter of the spheric portion 19*a*, and hence pressure fluid can flow in the passage 13*b* even if the spheric portion 19*a* is provided therein.

(Normal Mode)

(Forward Movement of Piston Rod)

As the pilot valve 2 produces an electromagnetic force, the first spring 17 contracts on account of a pilot pressure introduced into the valve unit 1 via the pilot port 11*g*, and hence the first valve body 14 is slid toward the left side of the figure (i.e. the first valve body 14 is standstill as it is in contact with the collar 16). In this state, the electromagnetic mechanism 18 having the flapper is operated to increase the fluid pressure P2 of the second passage 11*b* to be higher than the fluid pressure P1 of the first passage 11*a*. As a result, the second valve body 13 is slid toward the left side of the figure. The position where the second valve body 13 stops is determined based on the position signal for the second valve body 13, which is supplied from the feedback spring 19. More specifically, based on the position signal supplied from the feedback spring 19, the electromagnetic mechanism 18 moves the flapper to cause the fluid pressures P1 and P2 to be equal to each other (i.e. to balance the fluid pressure P1 with the fluid pressure P2) when the second valve body 13 reaches a predetermined position, so that the movement of the second valve body 13 is stopped (the same applies to stopping and backward movement of the piston rod 32, both of which will be described later). It is noted that details of the electromagnetic mechanism 18 having the flapper are shown in Japanese Unexamined Patent Publication No. 64702/1992 (Tokukai 4-64702).

Figure 3A:
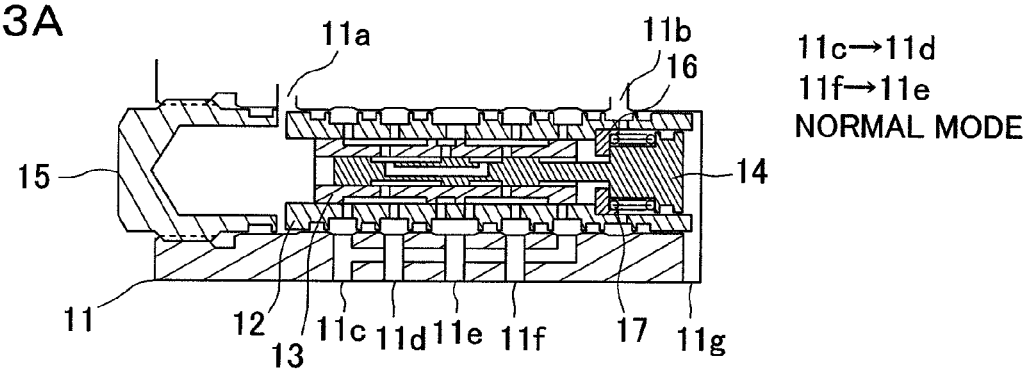
FIG. 3A is a cross section for explaining the operation of the valve unit of FIG. 2.

As a result of the above, as shown in FIG. 3A, the first state 1*a* is reached so that the pump port 11*c* is connected to the first cylinder port 11*d* whereas the second cylinder port 11*f* is connected to the tank port 11*e*. In this state, the pressure fluid from the pump 4 is introduced into the first cylinder chamber 31*a* of the cylinder 31 via the valve unit 1, the pressure fluid in the second cylinder chamber 31*b* returns to the tank 5 via the valve unit 1, and the piston rod 32 carries out the forward movement. The moving speed of the piston rod 32 is determined in accordance with a stop position (position after the sliding) of the second valve body 13 (the same applies to the later-described backward movement of the piston rod 32). Furthermore, although the supply passages are not illustrated, pressure fluid is supplied from the pump 4 to the first passage 11*a* and the second passage 11*b* via the flapper.

(Stopping of Piston Rod)

Figure 3B:
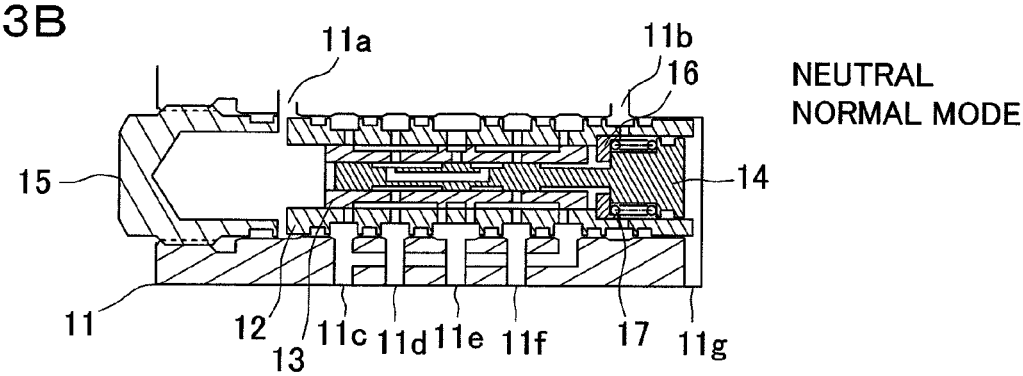
FIG. 3B is a cross section for explaining the operation of the valve unit of FIG. 2.

The electromagnetic mechanism 18 is operated while the pilot valve 2 produces an electromagnetic force, so that the fluid pressure P2 of the second passage 11*b* is arranged to be lower than the fluid pressure P1 of the first passage 11*a*. With this, the second valve body 13 is slid toward the right side of the figure. Thereafter, as shown in FIG. 3B, the second valve body 13 is stopped, when the third state 1*c* is reached so that the pump port 11*c*, the tank port 11*e*, the first cylinder port 11*d*, and the second cylinder port 11*f* are closed (mutually blocked). Eventually, the piston rod 32 is stopped and this stopped state is maintained.

(Backward Movement of Piston Rod)

Figure 3C:
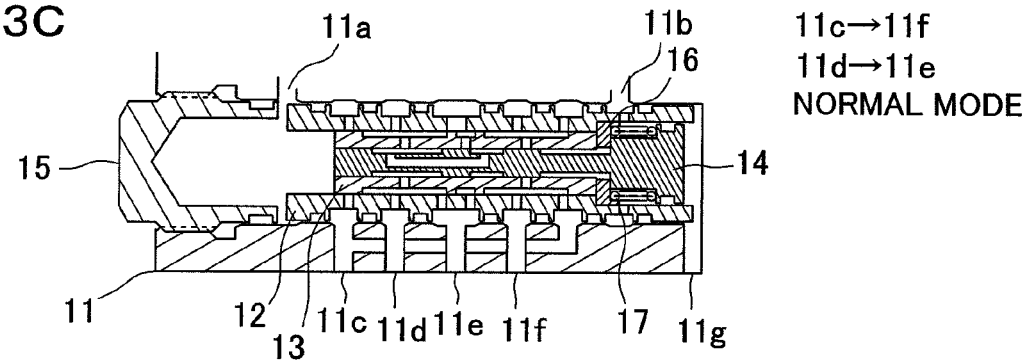
FIG. 3C is a cross section for explaining the operation of the valve unit of FIG. 2.
Figure 3D:
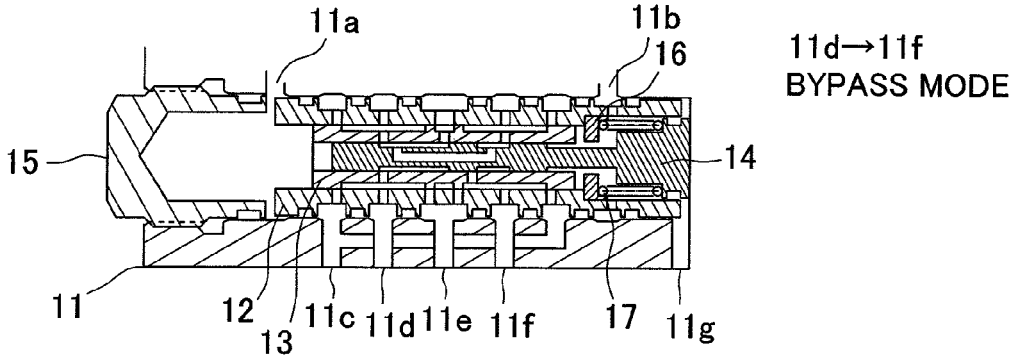
FIG. 3D is a cross section for explaining the operation of the valve unit of FIG. 2.

The electromagnetic mechanism 18 is operated while the pilot valve 2 produces an electromagnetic force, so that the fluid pressure P2 of the second passage 11*b* is arranged to be lower than the fluid pressure P1 of the first passage 11*a*. With this, the second valve body 13 is slid toward the right side of the figure. Thereafter, as shown in FIG. 3C, the second state 1*b* is reached so that the pump port 11*c* is connected to the second cylinder port 11*f* whereas the first cylinder port 11*d* is connected to the tank port 11*e*. In this state, the pressure fluid from the pump 4 is introduced into the second cylinder chamber 31*b* of the cylinder 31 via the valve unit 1, the pressure fluid in the first cylinder chamber 31*a* returns to the tank 5 via the valve unit 1, and the piston rod 32 carries out the backward movement.

As discussed above, the valve unit 1 of the present embodiment is arranged so that one of the first state 1*a*, the third state 1*c*, the second state 1*b*, and the fourth state 1*d* is reached according to a combination of a position of the first valve body 14 after the sliding and a position of the second valve body 13 after the sliding with respect to the first valve body 14. As previously described, both of the first valve body 14 and the second valve body 13 are slid by pressure fluid. The valve unit 1 does not require an electric motor for this reason, and it is therefore possible to provide a valve unit 1 which is smaller in size, lighter in weight, and consumers less power than conventional valve units. Furthermore, the first valve body 14 is assuredly slid by the first spring 17. In another aspect, the first valve body 14 is fixedly provided around the center of the valve unit 1 by the first spring 17. Since the first valve body 14 is fixedly provided around the center, the shift to each mode (first state 1*a* through third state 1*c*) is easily done when recovering from the loss of fluid pressure (breakdown of the pump 4) (i.e. when the pump 4 is back to normal).

(Second Embodiment)

Figure 4:
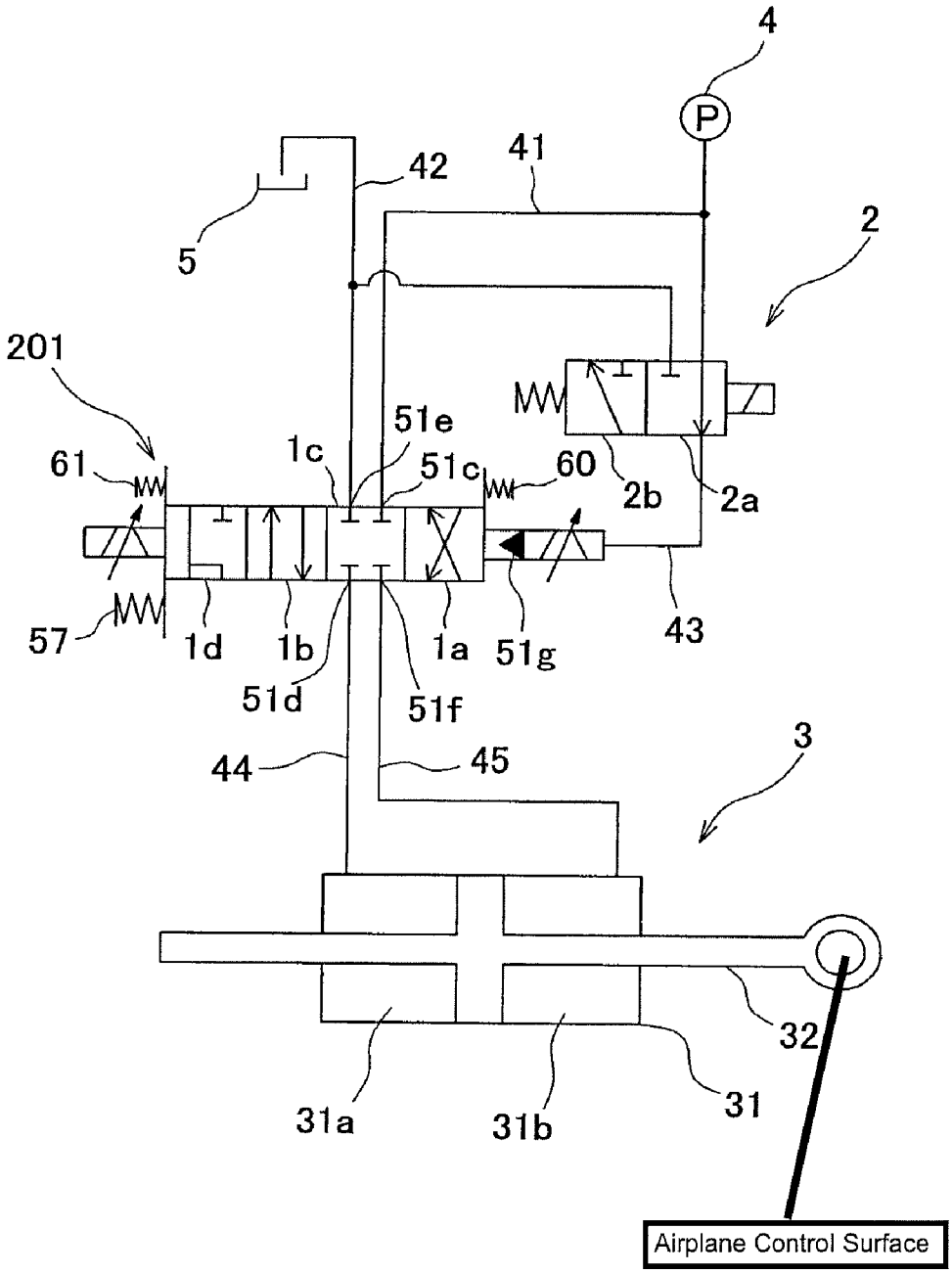
FIG. 4 is a circuit diagram of a hydraulic circuit in which a valve unit of Second Embodiment according to the present invention is incorporated.
Figure 5:
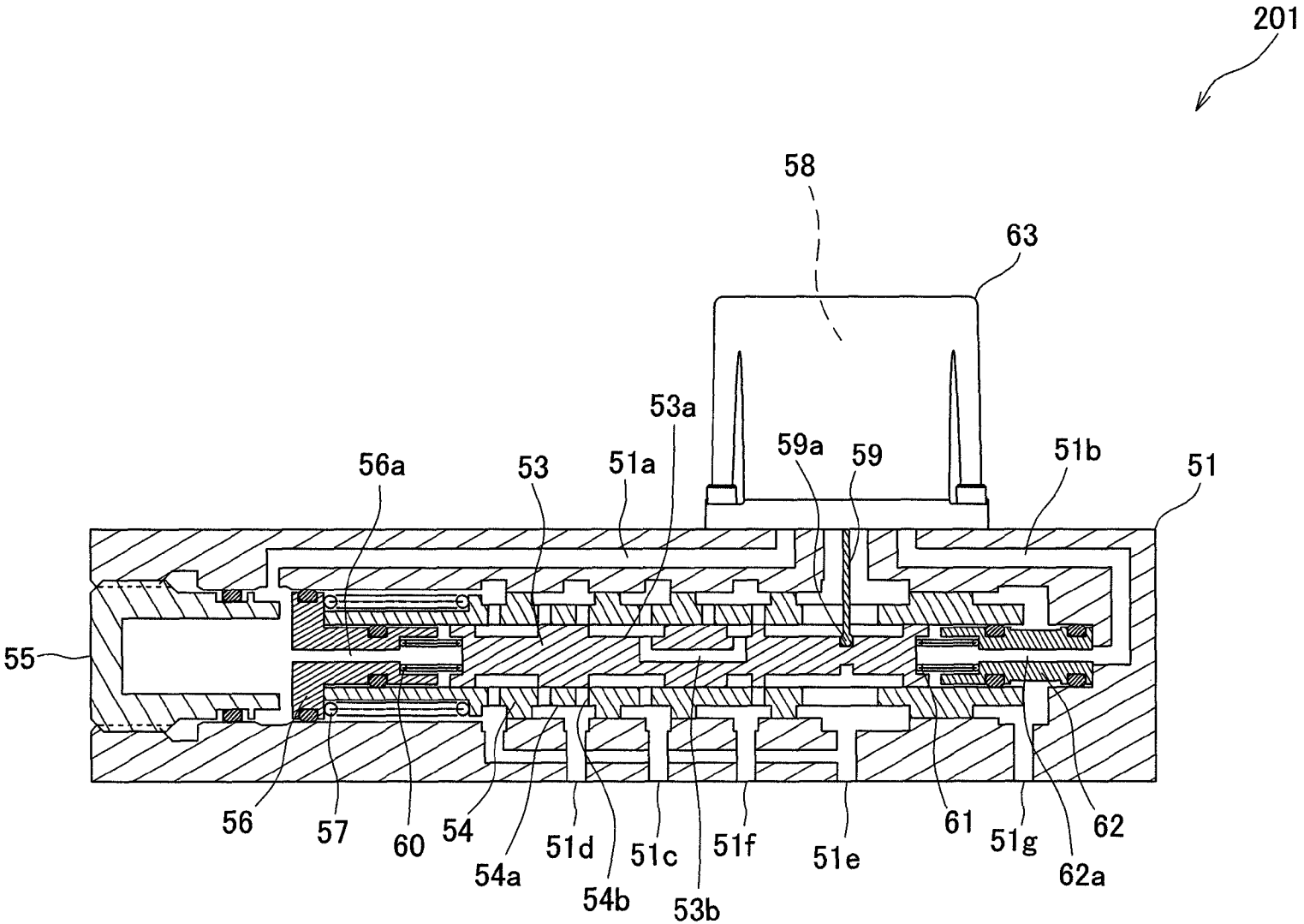
FIG. 5 shows the structure of the valve unit of FIG. 4.

FIG. 4 is a circuit diagram showing a hydraulic circuit in which a valve unit 201 of Second Embodiment according to the present invention is incorporated. FIG. 5 shows the structure of the valve unit 201 shown in FIG. 4. In FIG. 4, the same reference numerals are assigned to components having substantially identical arrangements as those of FIG. 1. The valve unit 201 shown in FIG. 5 is in the third state 1*c* (i.e. the neutral state in the normal mode). The present embodiment will be described focusing on the differences from First Embodiment.

A major difference between the valve unit 201 of the present embodiment and the valve unit 1 of First Embodiment lies in that, in the present embodiment, the second valve body 53 is provided at its end portions with a second spring 60 and a third spring 61 which bias a second valve body 53.

First of all, the valve housing 11, the cap 15, the first passage 11*a*, the second passage 11*b*, the pump port 11*c*, the first cylinder port 11*d*, the tank port 11*e*, the second cylinder port 11*f*, the pilot port 11*g*, the first spring 17, the casing 20, the electromagnetic mechanism 18, and the feedback spring 19 (including the spheric portion 19*a*) of First Embodiment are respectively identical with a valve housing 51, a cap 55, a first passage 51*a*, a second passage 51*b*, a pump port 51*c*, a first cylinder port 51*d*, a tank port 51*e*, a second cylinder port 51*f*, a pilot port 51*g*, a first spring 57, a casing 63, an electromagnetic mechanism 58, and a feedback spring 59 (including a spheric portion 59*a*) of Second Embodiment.

(First Valve Body)

The valve housing 51 houses therein a tubular first valve body 54 to be slidable with respect to the inner surface of the valve housing 51. The first valve body 54 is provided on its outer surface with plural ring-shaped circumferential grooves 54*a*. The space inside the first valve body 54 is connected to the grooves 54*a* via passages 54*b* formed in the first valve body 54. Furthermore, the first valve body 54 is provided at its one end portion with a first spring 57 (coil spring) which biases the first valve body 54 in an axial direction. The edge of this first spring 57 is in contact with a tubular member 56 which is disposed on one-end side of the first valve body 54 and has a passage 56*a* at its center.

(Second Valve Body)

In the present embodiment, the first valve body 54 houses therein a stick-shaped second valve body 53 to be slidable with respect to the inner surface of the first valve body 54. The second valve body 53 is provided on its outer surface with plural ring-shaped circumferential grooves 53*a*. Among these grooves 53*a*, the central two grooves 53*a* are connected with each other by a passage 53*b* formed in the second valve body 53.

(Second Spring)

The second spring 60 (coil spring) is disposed between the second valve body 53 and the tubular member 56 which are disposed to form a straight line. This second spring 60 biases the second valve body 53 in an axial direction.

(Third Spring)

A tubular member 62 having a passage 62*a* at its center is provided so that the second valve body 53 is sandwiched between the tubular member 62 and the second spring 60. Between the second valve body 53 and the tubular member 62 which form a straight line, a third spring 61 (coil spring) is disposed. This third spring 61 biases the second valve body 53 in an axial direction opposite to the direction of the biasing force of the second spring 60. The biasing force of the second spring 60 is equal to the biasing force of the third spring 61.

(Operation of Valve Unit)

Now, the operation of the valve unit 201 will be described. FIG. 6A through FIG. 6D are cross sections for describing the operation of the valve unit 201 shown in FIG. 5. FIG. 6A, FIG. 6B, FIG. 6C, and FIG. 6D show a first state 1*a*, a third state 1*c*, a second state 1*b*, and a fourth state 1*d* of the valve unit 201, respectively. It is noted that the same reference numerals are assigned to components having substantially identical arrangements as those of FIG. 5.

(Bypass Mode)

When the pilot valve 2 does not produce an electromagnetic force or when the pump 4 is broken down, no pilot pressure is introduced into the valve unit 201 via the pilot port 51*g*. In this case, the first valve body 54 is in the right side of the figure on account of the biasing force of the first spring 57 (i.e. the first valve body 14 is at a standstill as the end face of the first valve body 54 is in contact with the inner wall of the valve housing 51). With this, as shown in FIG. 6D, the fourth state 1*d* is reached so that the pump port 51*c* is closed while the first cylinder port 51*d*, the second cylinder port 51*f*, and the tank port 51*e* are connected to one another. As the first cylinder port 51*d* is connected to the second cylinder port 51*f*, the piston rod 32 of the hydraulic actuator 3 becomes movable by an external force (not illustrated).

(Normal Mode)

(Forward Movement of Piston Rod)

As the pilot valve 2 produces an electromagnetic force, the first spring 57 contracts on account of a pilot pressure introduced into the valve unit 201 via the pilot port 51*g*, and hence the first valve body 54 is slid toward the left side of the figure (i.e. the first valve body 54 is standstill as it is in contact with the tubular member 56). In this state, the electromagnetic mechanism 58 having the flapper is operated to increase the fluid pressure P2 of the second passage 51*b* to be higher than the fluid pressure P1 of the first passage 51*a*. As a result, the second valve body 53 is slid toward the left side of the figure.

Figure 6A:
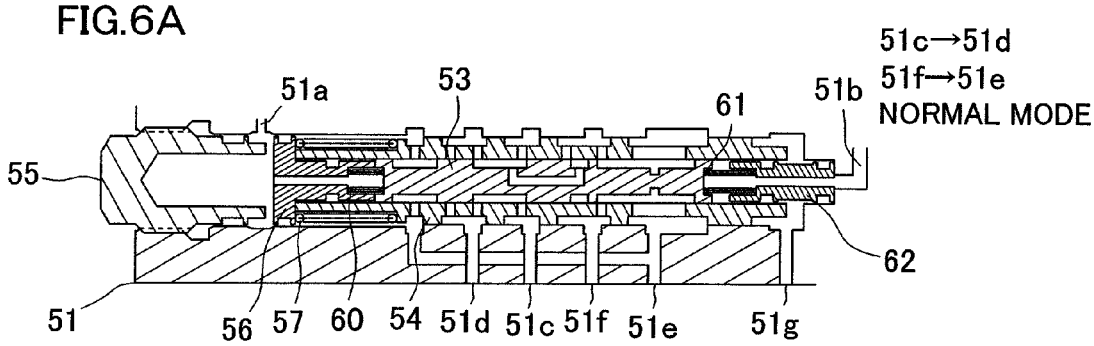
FIG. 6A is a cross section for explaining the operation of the valve unit of FIG. 5.

As a result, as shown in FIG. 6A, the first state 1*a* is reached so that the pump port 51*c* is connected to the first cylinder port 51*d* whereas the second cylinder port 51*f* is connected to the tank port 51*e*. In this state, the pressure fluid from the pump 4 is introduced into the first cylinder chamber 31*a* of the cylinder 31 via the valve unit 201, the pressure fluid in the second cylinder chamber 31*b* returns to the tank 5 via the valve unit 201, and the piston rod 32 carries out the forward movement. The moving speed of the piston rod 32 is determined in accordance with a stop position (position after the sliding) of the second valve body 53 (the same applies to the later-described backward movement of the piston rod 32).

(Stopping of Piston Rod)

Figure 6B:
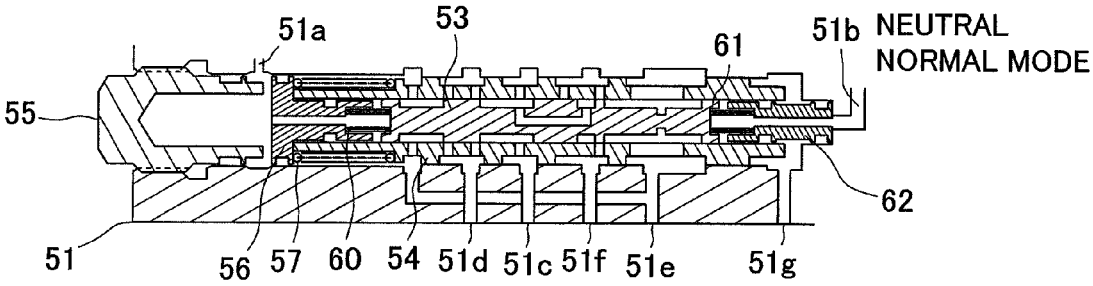
FIG. 6B is a cross section for explaining the operation of the valve unit of FIG. 5.

The electromagnetic mechanism 58 is operated while the pilot valve 2 produces an electromagnetic force, so that the fluid pressure P2 of the second passage 51*b* is arranged to be lower than the fluid pressure P1 of the first passage 51*a*. With this, the second valve body 53 is slid toward the right side of the figure. Thereafter, as shown in FIG. 6B, the second valve body 53 is stopped, when the third state 1*c* is reached so that the pump port 51*c*, the tank port 51*e*, the first cylinder port 51*d*, and the second cylinder port 51*f* are closed (mutually blocked). Eventually, the piston rod 32 is stopped and this stopped state is maintained.

(Backward Movement of Piston Rod)

Figure 6C:
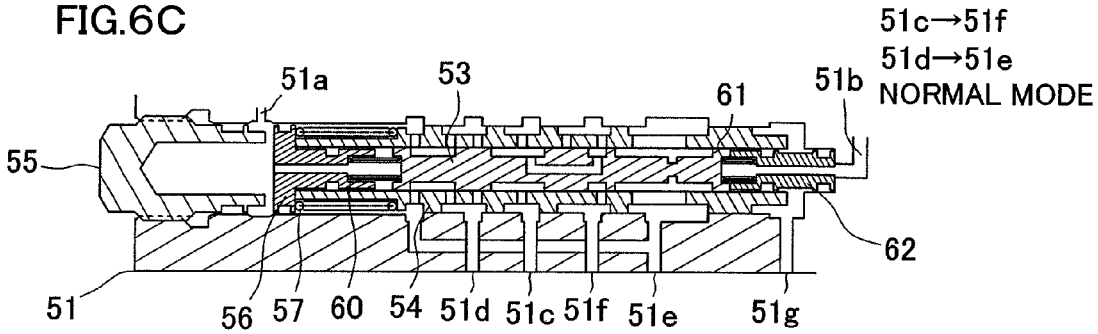
FIG. 6C is a cross section for explaining the operation of the valve unit of FIG. 5.
Figure 6D:
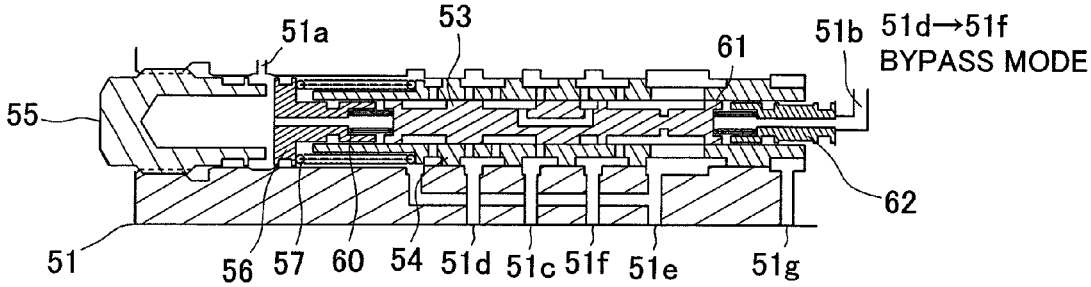
FIG. 6D is a cross section for explaining the operation of the valve unit of FIG. 5.

The electromagnetic mechanism 58 is operated while the pilot valve 2 produces an electromagnetic force, so that the fluid pressure P2 of the second passage 51*b* is arranged to be lower than the fluid pressure P1 of the first passage 51*a*. With this, the second valve body 53 is slid toward the right side of the figure. Thereafter, as shown in FIG. 6C, the second state

1*b* is reached so that the pump port 51*c* is connected to the second cylinder port 51*f* whereas the first cylinder port 51*d* is connected to the tank port 51*e*. In this state, the pressure fluid from the pump 4 is introduced into the second cylinder chamber 31*b* of the cylinder 31 via the valve unit 1, the pressure fluid in the first cylinder chamber 31*a* returns to the tank 5 via the valve unit 1, and the piston rod 32 carries out the backward movement.

As described above, the valve unit 201 of the present embodiment is advantageous in that, since the second spring 60 and the third spring 61 are provided at the both ends of the second valve body 53, sudden changes in the fluid pressures P1 and P2 do not result in an undesirable quick action of the second valve body 53 because the second spring 60 and the third spring 61 function as cushioning members. In other words, the second valve body 53 moves smoothly, and hence the piston rod 32 moves smoothly. In another aspect, since the second spring 60 and the third spring 61 are disposed at the both ends of the second valve body 53, the second valve body 53 can be fixedly provided around the center of the valve unit 201 by a simple structure and without increasing the weight. With this, the shift to each mode (first state 1*a* through third state 1*c*) is easily done when recovering from the loss of fluid pressure (breakdown of the pump 4) (i.e. when the pump 4 is back to normal).

While this invention has been described in conjunction with the specific embodiments outlined above, it is evident that many alternatives, modifications and variations will be apparent to those skilled in the art.

What is claimed is:

1. A valve unit comprising:

a valve housing;

a first valve body disposed in the valve housing in a slidable manner; and a second valve body disposed to be slidable with respect to the first valve body, wherein, the valve housing includes:

a first passage and a second passage in which pressure fluid flows to slide the second valve body;

a pump port connected to a pump;

a tank port connected to a tank; and a first cylinder port and a second cylinder port both connected to a cylinder of a hydraulic actuator, and wherein, a combination of a position of the first valve body after sliding and a position of the second valve body after sliding with respect to the first valve body achieves:

a first state in which the pump port is connected to the first cylinder port whereas the second cylinder port is connected to the tank port;

a second state in which the pump port is connected to the second cylinder port whereas the first cylinder port is connected to the tank port;

a third state in which the pump port, the tank port, the first cylinder port, and the second cylinder port are closed; and a fourth state in which the pump port is closed whereas the first cylinder port is connected to the second cylinder port.

2. The valve unit according to claim 1, wherein, the position of the second valve body is controlled based on a position signal supplied from a feedback spring, a part of the feedback spring being provided in the valve housing.

3. The valve unit according to claim 1, wherein, the first valve body is disposed to be slidable with respect to an inner surface of the second valve body, and the first valve body is provided at its end portion with a first spring which biases the first valve body.

4. The valve unit according to claim 1, wherein, the first valve body is disposed to be slidable with respect to an outer surface of the second valve body, the first valve body is provided at its end portion with a first spring which biases the first valve body, and the second valve body is provided at its respective end portions with a second spring and a third spring both of which bias the second valve body.

5. The valve unit according to claim 1, wherein, an airplane control surface is attached to a leading end of a piston rod of the hydraulic actuator.

* * * * *